US006610973B1

(12) United States Patent
Davis, III

(10) Patent No.: US 6,610,973 B1
(45) Date of Patent: Aug. 26, 2003

(54) PILL COUNTING AID USING A PLANAR LIGHT DIFFUSING PANEL FOR RECEIPT AND RETENTION OF THE PILLS

(76) Inventor: John Merrill Davis, III, 12418 Queensgate Rd., Midlothian, VA (US) 23113

( * ) Notice: Subject to any disclaimer, the term of this patent is extended or adjusted under 35 U.S.C. 154(b) by 0 days.

(21) Appl. No.: 10/093,162

(22) Filed: Mar. 6, 2002

Related U.S. Application Data

(63) Continuation of application No. 09/361,899, filed on Jul. 27, 1999, now Pat. No. 6,549,621.

(51) Int. Cl.[7] ..... H01J 40/14
(52) U.S. Cl. ..... 250/222.1
(58) Field of Search ..... 250/222.1, 341.8; 221/1; 348/91; 377/6; 382/100, 192; 209/900

(56) References Cited

U.S. PATENT DOCUMENTS 3,811,036 A * 5/1974 Perry ..... 235/92
3,936,800 A * 2/1976 Ejiri et al. ..... 340/146.3
4,175,860 A * 11/1979 Bacus ..... 356/39
4,338,024 A * 7/1982 Bolz et al. ..... 356/23
4,901,865 A * 2/1990 Staples ..... 209/703
5,042,685 A * 8/1991 Moulding et al. ..... 221/1
5,558,231 A * 9/1996 Weier ..... 209/580
5,808,305 A * 9/1998 Leidecker et al. ..... 250/341.8
6,075,882 A * 6/2000 Mullins et al. ..... 382/141

* cited by examiner

*Primary Examiner*—Stephone B Allen

(57) ABSTRACT

A vision based pill counting aid and method that rely on an electronic camera and a source of detectable radiation to detect pill/capsule image or silhouette and thereby, through the use of appropriate software, provide an accurate pill/capsule count. According to a preferred embodiment of the present invention low cost, inexpensive, low power, and cool LED radiation sources are utilized as the imaging radiation source. A preferred CMOS camera that incorporates a vision chip detects the number of pixels of radiation interrupting the radiation from the LEDs reaching the CMOS camera. Through the use of appropriate software, the number of pills/capsules present in the field of view of the CMOS camera is determined and communicated to an operator through a display device.

17 Claims, 2 Drawing Sheets

10

PILL COUNTING AID USING A PLANAR LIGHT DIFFUSING PANEL FOR RECEIPT AND RETENTION OF THE PILLS

This application is a continuation of U.S. patent application Ser. No. 09/361,899 filed Jul. 27, 1999 now U.S. Pat. No. 6,549,621.

FIELD OF THE INVENTION

The present invention relates to devices for counting pills, capsules or the like ingested for medical purposes and more specifically, to such devices that are automated and based on vision analysis capabilities.

BACKGROUND OF THE INVENTION

In the distribution of dosage-size quantities of prescription drugs in pill, capsule or other similar form the need to accurately count the prescription number is a tedious and often inaccurate task. Furthermore, in the case of pills, the counting methods currently used, i.e. handling with a spatula or similar device on a plastic or stainless steel tray, can often lead to attrition or erosion of the pills, thus possibly reducing the required dosage per pill.

It would therefore be of significant value to provide some type of "automated" pill counting aid that provided an accurate count of the individual pills or capsules without the need for the pharmacist to count them individually. Such a system could eliminate much of the handling and attrition currently encountered in the counting process and also improves the repetitive and tedious nature of the counting operation.

OBJECTS OF THE INVENTION

It is therefore an object of the present invention to provide an accurate vision based counting aid that eliminates much of the handling and manual pill counting currently used.

It is another object of the present invention to provide such a vision based system that is immune from interferences that are normally present in the ambient conditions under which pill counting is accomplished.

SUMMARY OF THE INVENTION

According to the present invention there is provided a vision-based pill/capsule counting aid and method, which rely on an electronic camera and a source of detectable light to detect pill/capsule silhouette and thereby, through the use of appropriate software, provide an accurate pill/capsule count.

According to a highly preferred embodiment of the present invention low cost, inexpensive, low power, and cool infrared LED light sources are utilized. A highly preferred CMOS imaging integrated circuit detects the image of the pills. Through the use of appropriate software, the number of pills/capsules present in the field of view of the CMOS camera is determined and communicated to an operator via an appropriate display device.

According to an alternative preferred embodiment visual radiation is utilized in combination with a conventional CCD camera and appropriate software to obtain the required pixel count and related pill/capsule count.

According to an alternative preferred embodiment visual radiation is visible light rather than infrared and the imaging device is able to distinguish colors of visible light.

According to the present invention, there is also provided a method for assisting the pill counting process using the pill counting aid of the present invention.

DETAILED DESCRIPTION

Figure 1:
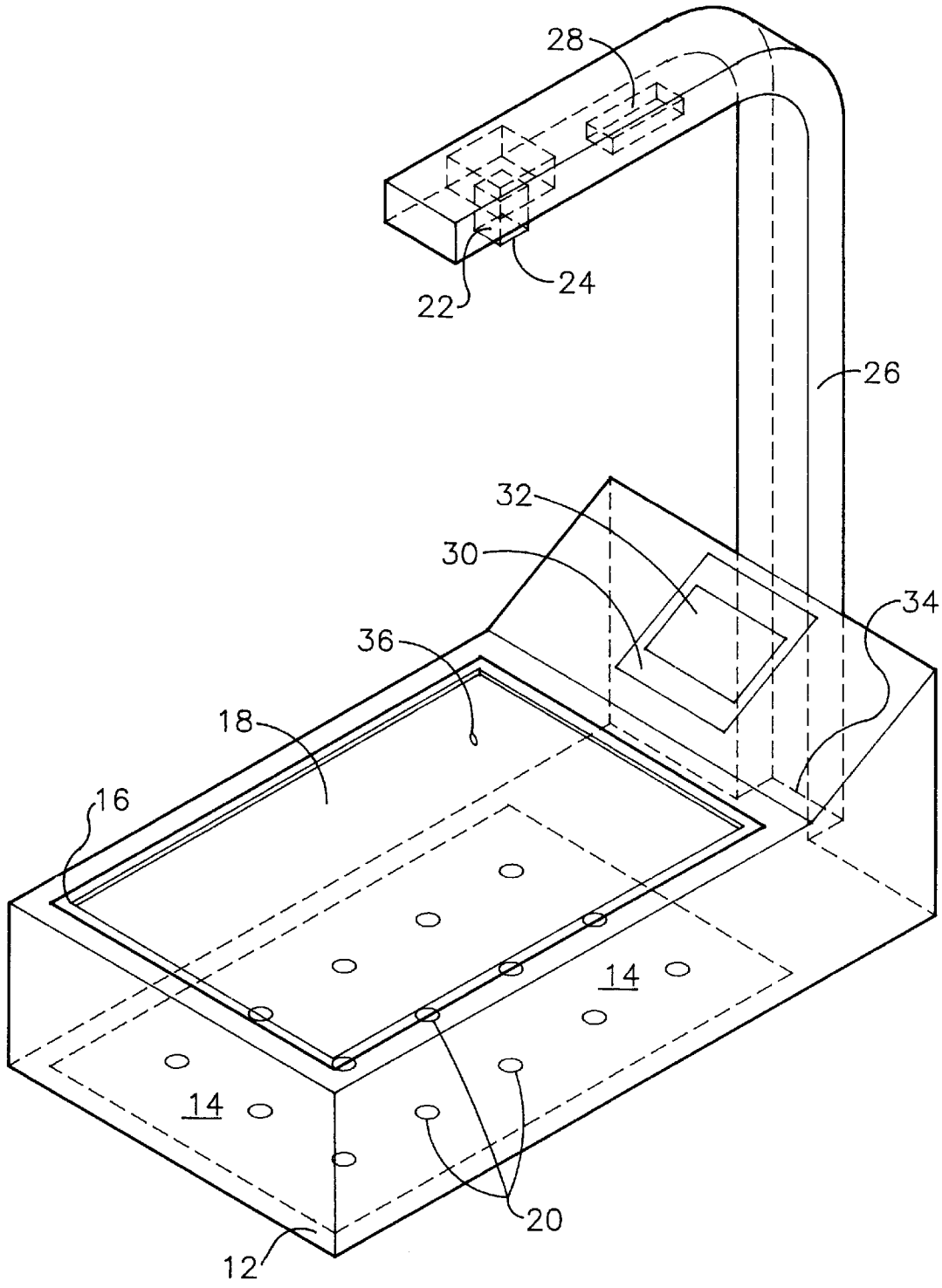
FIG. 1 is a perspective view of one preferred embodiment of the pill counting aid of the present invention.

As shown in FIG. 1, the pill counting device 10 comprises a base 12 having sides 14, top 16, which includes "translucent" panel 18. The term "translucent" as used herein is meant to define the property of being permeable to the detecting radiation whether it be visible, infrared or ultraviolet and is not meant to be limited only to radiation in the visible spectrum. Within base 12 and below translucent panel 18 are radiation sources 20. Located above translucent panel 18 is an appropriate radiation-detecting camera 22 including a lens, or other suitable focusing device 24 for appropriately focusing on pills/capsules placed upon translucent panel 18. Camera 22 and associated lens, or other suitable focusing device 24 are supported in their position above translucent panel 18 by support 26. According to the embodiment depicted in FIG. 1, support 26 further includes a processor 28 and an output device 30 whose purposes and configurations will be described in detail hereinafter.

Base 12 simply provides support for the balance of device 10, as a protective housing for radiation sources 20, and as a "dark" background for the pixel counting operation. Consequently, it may be of any suitable configuration and produced from any suitable material such as metals, polymers, etc. As described below, it may also be used to house the camera portion of the device of the present invention when the locations of the radiation detector and radiation emitter are reversed.

The principal role of translucent panel 18 is to provide a flat or planar surface as a "background" for the vision based counting system of the present invention. Translucent panel 18 is preferably of glass and most preferably of a diffusing glass that assists in the elimination of shadows that might affect the silhouette imaging process of the present invention. Frosted glass for example would be adequate in this application. According to a highly preferred embodiment translucent panel 18 comprises so-called "opal" glass, i.e. a glass that comprises two distinct layers, one clear and the other translucent. Such opal glass provides optimum elimination of shadows while permitting permeation of the detecting radiation. Any glass or other material, for example polymeric materials, that permits passage of the detecting radiation and does not risk contamination of the pills, capsules etc. being counted can be used as translucent panel 18. Glass provides the same sterile environment as stainless steel, the current material of choice for counting tablets, while providing the required optical properties necessary for the successful practice of the present invention, and is therefore, preferred as translucent panel 18.

Support 26 serves to position camera 22 above translucent panel 18 in the appropriate viewing position. The configuration of support 26 depicted in FIG. 1 is optimal since it does not interfere with an operator positioning items to be counted on translucent panel 18, properly positions camera 22 over translucent panel 18 and permits an unobstructed view of output device 30 during the entire counting operation. Additionally, support 26 as depicted in FIG. 1 is of a size to conveniently accommodate processor 28. Of course processor 28 may be included at any other suitable position within device 10, for example at the base 34 of support 26, if desired. Any other design of support 26 may be utilized so long as it provides proper location of camera 22 and provides relative ease of distribution of pills/capsules on translucent panel 18.

A variety of cameras and complimentary radiation sources may be used in the counting system of the present invention depending upon the environment of use, and other factors inherent in the counting process.

According to a highly preferred embodiment of the present invention radiation sources 20 comprise LEDs, light emitting diodes. LEDs are preferred because they are inexpensive, require low power, and produce a "cool" light in the IR (infrared) range. Such radiation does not affect the vision of the operator, eliminates interference with the imaging process by overhead fluorescent lighting and is readily detectable by the preferred CMOS (complimentary metal oxide semi conductor) cameras. The array of radiation sources 20 must be such as to provide complete "non-shadowing" coverage of translucent panel 18, if an accurate measurement, count, is to be obtained. A hexagonal array of radiation sources 20 that each emit over an ideally 180° field provides an optimum such array.

When, as described hereinafter, the camera of choice is a more conventional CCD camera, more conventional visible light sources that emit radiation in the visible range may be used in lieu of the preferred CMOS camera and LED configuration, or infrared emitters such as LEDs may be used since CCD cameras may also be sensitive to this radiation. Whatever the source of detectable radiation and radiation detector or camera used, color imaging is not necessary since the system of the present invention relies effectively on the detection of the optical silhouette of the capsule, pill, etc. being counted and in no way on the color of the particular counted item. Similarly, it should be noted that the configuration or shape of the item being counted is not critical and will not influence the capability of the device and method of the present invention to provide an accurate count. Thus, pills or capsules of round, square, triangular, etc. configuration can be accurately counted using the device and method of the present invention so long as, when distributed on translucent panel 18, each individual item presents the same silhouette to radiation detection device or camera 22.

As mentioned above, camera 22 may be of a number of types depending upon the detecting radiation being utilized. The preferred CMOS camera is particularly well adapted to the current application, because of its IR sensitivity which eliminates interferences that might be caused by ambient light in the area of the counting process and the elimination of the need for visible light which could be distracting or irritating to the operator. When the CMOS camera is used in the device of the present invention, focusing device or lens 24 is preferably a combination of a conventional lens and a "dichroic" filter that focuses and filters the radiation emitted by LEDs 20 to a narrow bandwidth about the 880 nm wavelength. At this radiation wavelength virtually all interference (except that from direct incandescent spotlights) from ambient visible light is eliminated and thus cannot interfere with the counting measurement. Another role of filter or lens 20 is to increase the signal to noise ratio of the detection operation by narrowing the detection band thereby eliminating unwanted interference that might be generated by the ambient environment.

Whatever camera system is used in the device of the present invention, optical, IR etc. it should include a single chip MOS image sensor that digitizes the incoming radiation such that the digitized information may be forwarded to processor 28 for analysis and interpretation using any number of conventional and improved analysis schemes.

Processor 28 may be of any suitable configuration well known to those skilled in the image analysis/vision systems art. For reasons of cost and simplicity, it is preferred to use an embedded microcontroller device and 32-bit software as the image interpretation tool. The Hitachi SH7045 processor, for example, is entirely adequate for this purpose.

As shown in FIG. 1, device 10 includes an output device 30 that displays the count detected by the system of the present invention. Output device 30 is depicted in FIG. 1 as an LCD or liquid crystal display that receives information from processor 28 and displays the appropriate numerical or alpha information on screen 32. While such a simple and low energy display is preferred, it will be obvious to the skilled technician that any number of alternative displays can be used. For example, an analog display could be provided or even a computer-generated voice provided in the case of visually challenged operators. The particular display type and its location onboard or separate from device 10 is not of critical importance, so long as the information, pill count, produced by device 10 is adequately communicated to the operator in the area of device 10, or, if desired, at a remote location.

In use, the pills, capsules etc. to be counted are distributed in a single layer on translucent panel 18. According to a preferred embodiment of the invention, a single sample of the item to be counted 36 is placed at a predetermined location on translucent panel 18 as a reference against which camera 22 and processor 28 can calculate the obstructed pixel count of a single item. The counting cycle is initiated by activating radiation sources 20. According to a preferred embodiment, radiation sources 20 are alternately illuminated and extinguished during a predetermined measurement cycle, perhaps ten illuminations of the radiation sources 20 so that a set of discrete measurements are supplied by the camera to processor 28. Image analysis software, which is designed to calculate the number of pills present on translucent panel 18 based on the silhouettes, i.e. the number of pixels of radiation interrupted by the items on translucent panel 18 and viewed by camera 22, and installed on processor 28, then performs this calculation and forwards the result to display 30 for presentation to the operator.

A variety of software tools are available and known to the skilled artisan for use in determining the number of pills present. As described above, for example, discrete pills can be measured by simply counting the number of pixels interrupted by the items on translucent panel 18. Clusters of pills can be measured by measuring concentrations of pixels interrupted and applying threshold analysis and histograms to obtain the pill count. More sophisticated software that does not form a part of the instant invention may, of course, be used as desired.

Figure 2:
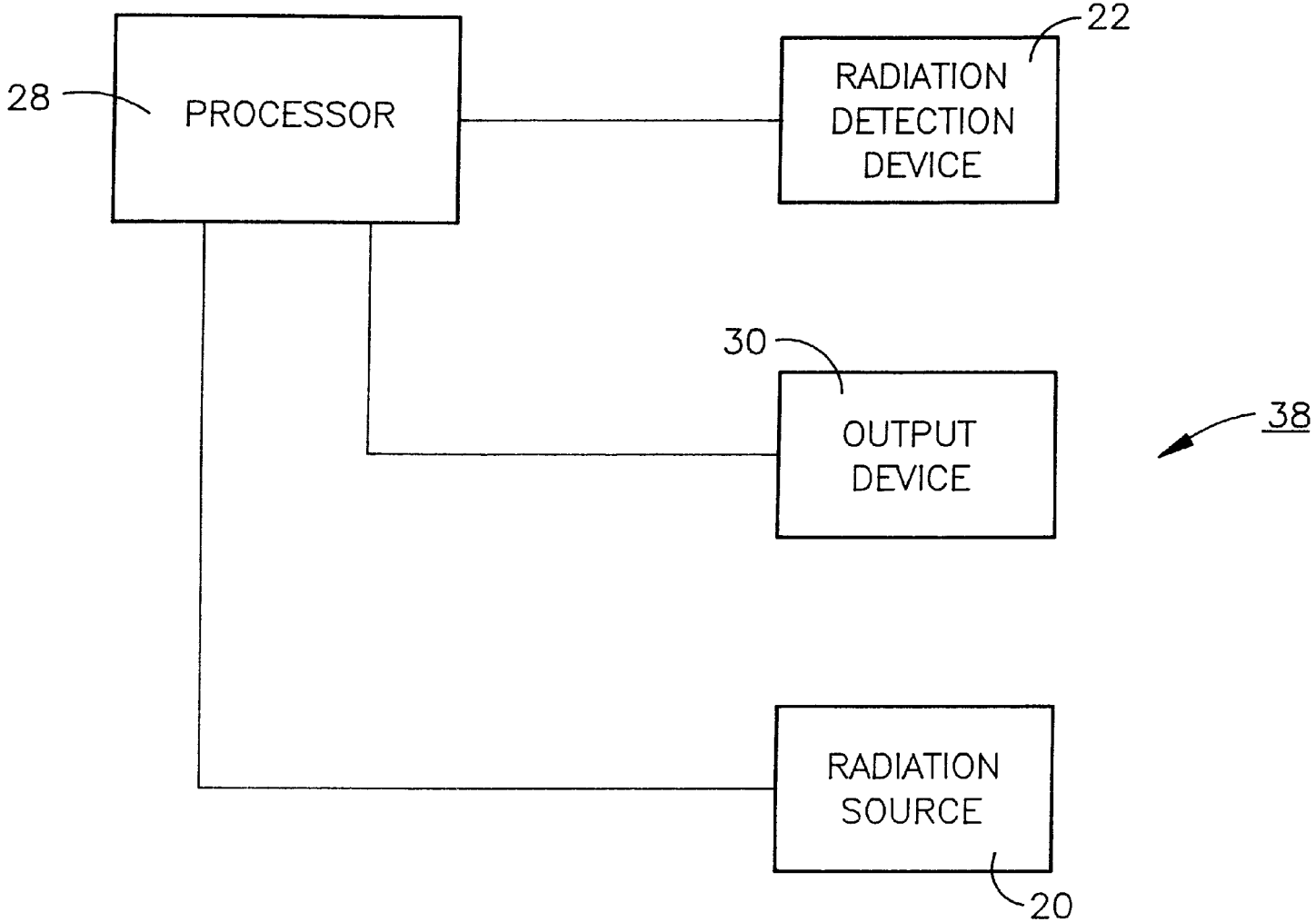
FIG. 2 is a schematic diagram showing the principle operating elements of the pill counting aid of the present invention.

A schematic diagram 38 of the system of the present invention depicting the essential elements thereof is shown in FIG. 2. The imaging operation is controlled, by processor 28 that determines the illumination cycle of radiation sources 20 and the detection cycle of camera 22 that includes digitizing capability. Once the appropriate imaging cycle is completed, the digitized images are forwarded to processor 28 for analysis; interpretation and pill count determination. When this operation is complete, the information including the number of counted items is forwarded to output device 30 for display/communication to the operator. When, according to the preferred embodiment described above, a reference item is located in a predetermined area of translucent panel 18, an initial measurement is made by camera 22 in that limited area to obtain a reading of the silhouette of a single item.

It will be obvious to skilled artisans, with the teachings of the present invention before them, that the relative positions of camera 22 and radiation sources 20 can be reversed, i.e. the radiation source could be mounted on support 26 and camera 22 located inside of base 12. The shortcoming of this arrangement is that interference by ambient radiation is, of course, more difficult to deal with since significantly more radiation from radiation source 20 will be required to provide the required contrast between the pill/capsule and the planar surface of translucent panel 18 which now becomes the background of camera 22's view.

It will also be apparent to the skilled artisan that a significantly less effective and efficient device could be constructed by placing both the radiation source and the radiation detector on the same side of a reflective panel that delivers radiation, even ambient light, to the radiation detector upon which the pills/capsules to be counted are placed.

As the invention has been described, it will be apparent to those skilled in the art that the same may be varied in many ways without departing from the spirit and scope of the invention. Any and all such modifications are intended to be within the scope of the appended claims.

What is claimed is:

1. A pill/capsule counting aid comprising:

a) a radiation detector including image digitizing capability;

b) an array of radiation sources that emit radiation capable of detection by said radiation detector;

c) a planar light diffusing panel between said radiation detector and said array of radiation sources for receipt and retention of pills/capsules deposited thereon;

d) a processor connected to said radiation detector for receiving digitized images from said radiation detector and including software for determining the number of pills/capsules deposited on said planar light diffusing panel when radiation emitted by said array of radiation sources through said planar light diffusing panel having pills/capsules deposited thereon is captured by said radiation detector; and e) an output device connected to said processor for communicating the number of pills/capsules deposited on said planar light diffusing panel to an operator.

2. The pill/capsule counting aid of claim 1 wherein said radiation detector is a camera that includes a focusing device.

3. The pill/capsule counting aid of claim 2 wherein said camera is selected from the group consisting of CCD and CMOS cameras and said source of radiation is selected from the group consisting of visible light radiation sources and infrared radiation sources.

4. The pill/capsule counting aid of claim 3 wherein said infrared radiation source comprises an array of LEDs.

5. The pill/capsule counting aid of claim 4 further including a dichroic filter on said lens.

6. The pill/capsule counting aid of claim 5 wherein said dichroic filter allows passage of a narrow band of infrared radiation about the 880 nm wavelength.

7. The pill/capsule counting aid of claim 1 further including a base that encompasses said source of radiation and a support that positions said radiation detector on the side of said planar translucent panel opposite that which abuts said source of radiation.

8. The pill/capsule counting aid of claim 1 wherein said planar light diffusing panel comprises opal glass.

9. The pill/capsule counting aid of claim 1 wherein said output device is selected from the group consisting of LCD, vocal and analog displays.

10. A method for counting pills and/or capsules comprising;

A) depositing the pills/capsules to be counted on the planar light diffusing surface of a pill/capsule counting aid comprising:

a) a radiation detector including image digitizing capability;

b) an array of radiation sources that emit radiation capable of detection by said radiation detector;

c) a planar light diffusing panel between said radiation detector and said array of radiation sources for receipt and retention of pills/capsules deposited thereon in direct contact with said light diffusing panel;

d) a processor connected to said radiation detector for receiving digitized images from said radiation detector and including software for determining the number of pills/capsules deposited on said planar light diffusing panel when radiation emitted by said array of radiation sources through said planar light diffusing panel having pills/capsules deposited thereon is captured by said radiation detector; and e) an output device connected to said processor for communicating the number of pills/capsules deposited on said planar translucent panel to an operator;

B) emitting radiation from said array of radiation sources, through said planar light diffusing panel to said radiation detector;

C) collecting images of said radiation detected by said radiation detector;

D) digitizing said images and transmitting said images to said processor;

E) determining the number of pills/capsules deposited on said planar light diffusing panel using software operated by said processor; and F) transmitting said number to said display device for communication to said operator.

11. The method of claim 10 wherein said radiation detector is a camera that includes a focusing device.

12. The method of claim 11 wherein said camera is selected from the group consisting of CCD and CMOS cameras and said array of radiation sources comprises an array of radiation sources is selected from the group consisting of visible light radiation sources and infrared radiation sources.

13. The method of claim 12 wherein said infrared radiation source comprises an LED.

14. The method of claim 13 further including a dichroic filter on said lens.

15. The method of claim 14 wherein said dichroic filter allows passage of a narrow band of infrared radiation about the 880 nm wavelength.

16. The method of claim 10 wherein said planar light diffusing panel comprises opal glass.

17. The method of claim 10 wherein said output device is selected from the group consisting of LCD, vocal and analog displays.

* * * * *

UNITED STATES PATENT AND TRADEMARK OFFICE

CERTIFICATE OF CORRECTION

PATENT NO. : 6,610,973 B1
DATED : August 26, 2003
INVENTOR(S) : Davis, John Merrill III It is certified that error appears in the above-identified patent and that said Letters Patent is hereby corrected as shown below:

Title page,
Item [63], Related U.S. Application Data, delete "now Pat. No. 6,549,621".

Column 1,
Lines 6 and 7, delete "now Pat. No. 6,549,621".

Signed and Sealed this

Fourth Day of May, 2004

JON W. DUDAS
*Acting Director of the United States Patent and Trademark Office*